United States Patent [19]

Khare

[11] Patent Number: 4,861,549

[45] Date of Patent: Aug. 29, 1989

[54] ROLLER CASTER SHELL STEEL

[75] Inventor: Ashok E. Khare, Warren, Pa.

[73] Assignee: National Forge Company, Irvine, Pa.

[21] Appl. No.: 157,657

[22] Filed: Feb. 18, 1988

[51] Int. Cl.[4] ..... C22C 38/44; C22C 38/46

[52] U.S. Cl. ..... 420/109; 420/83; 29/132; 148/335

[58] Field of Search ..... 420/83, 109; 148/335; 29/132

[56] References Cited

U.S. PATENT DOCUMENTS

| | | | |
|---|---|---|---|
| 3,165,402 | 1/1965 | Finkl | 420/108 |
| 3,166,407 | 1/1965 | Knoth et al. | 420/109 |
| 3,219,442 | 11/1965 | Johnstin | 420/111 |
| 3,912,553 | 10/1975 | Waid et al. | 420/109 |
| 3,954,517 | 5/1976 | Jatczak et al. | 420/109 |
| 4,004,952 | 1/1977 | Jatczak et al. | 420/109 |
| 4,026,727 | 5/1977 | Finkl et al. | 148/335 |
| 4,072,509 | 2/1978 | Zorev et al. | 420/109 |
| 4,409,027 | 10/1983 | Cordea et al. | 420/109 |
| 4,650,645 | 3/1987 | Kato et al. | 420/111 |

FOREIGN PATENT DOCUMENTS

| | | | |
|---|---|---|---|
| 607222 | 10/1960 | Canada . | |
| 54-26975 | 9/1979 | Japan | 420/109 |
| 53-4716 | 1/1987 | Japan . | |
| 338551 | 6/1972 | U.S.S.R. . | |
| 350858 | 9/1972 | U.S.S.R. . | |
| 894842 | 4/1962 | United Kingdom . | |

OTHER PUBLICATIONS

Key to Steels, Verlag Stahlschüssel Wegst KG. West Germany, 10 Edition 1974.

Deeley et al., *Ferroalloy & Alloying Additives Handbook,* "Cerium & Rare Earths," Shieldalloy Corp./Metallurg Alloy Corp., (1981), pp. 24–26.

Garcia et al., *Journal of Metals,* "Reducing Temper Embrittlement by Lanthanide Additions," (Sep. 1983), pp. 22–28.

*Primary Examiner*—Deborah Yee

*Attorney, Agent, or Firm*—Wayne M. Kennard

[57] ABSTRACT

A ferritic alloy steel for roller caster shells with high heat resistance to heat checking or cracking used in continuously roll casting aluminum into sheets consisting essentially of from 0.45% to 0.49% carbon, 0.90% to 1.00% manganese, 0.010% maximum phosphorus, 0.002% maximum sulphur, 0.15% to 0.35% silicon, 1.20% to 1.50% nickel, 1.20% to 1.45% chromium, 0.80% to 1.00% molybdenum, 0.14% to 0.20% vanadium, 0.08% maximum rare earth, and balance essentially iron.

6 Claims, No Drawings

ROLLER CASTER SHELL STEEL

TECHNICAL FIELD

The present invention relates to the field ferritic alloy steels for making roller caster shells used in continuously roller casting molten metals into sheets. More specifically, the present invention relates to ferritic alloy steels for making roller caster shells with high resistance to heat checking or cracking used in continuously roller casting molten aluminum into sheets.

BACKGROUND OF THE INVENTION

Generally, direct casting methods are used to cast molten aluminum into sheets. According to such methods, molten aluminum is first fed to a reservoir. The molten aluminum goes from the reservoir to a nozzle section. The nozzle of this section is a chilling nozzle. The molten aluminum solidifies as it issues from chilling nozzle.

A pair of water-cooled roller caster shells are disposed adjacent the end of the chilling nozzle. These shells, which rotate in opposite directions, receive the solidifying, yet malleable, aluminum in their nip as it issues from a chilling nozzle. The roller caster shells hot roll the solidifying aluminum into sheets. Depending on the size and separation of the shells, aluminum sheets of various thicknesses and widths are produced.

Since the shells are water-cooled, they further cool the aluminum as it passes through the nip. As the aluminum sheet leaves the nip, it is cooled to point at which it will maintain its shape or form.

During each thermal cycle in the casting process, roller caster shells are subject to extreme heat stresses. These heat stresses cause heat checking or cracking ("heat cracking") in the shells. If the cracking goes unattended, the heat stresses in subsequent thermal cycles will propagate the cracking. The cracks that are formed cause marks in the aluminum sheet, which is undesirable, and the propagating of cracks eventually renders the shell unusable. The speed of crack propagation in a given shell determines the service life of a given shell.

Manufacturers of aluminum sheet have always wanted roller caster shells with service lives as long as possible for both practical and economic reasons. Prior art roller caster shells for continuously roll casting aluminum into sheets have various chemistries. The various prior art chemistries stress the criticalness of the weight percentages of one or more constituent elements. Meeting these specific weight percentages for these elements is the basis for the alleged increased service life of such prior art shells.

To increase the service life of roller caster shells, the apparatus upon which the shells are mounted is periodically shut down to machine the outer surface of the shells. Remachining removes the cracks before they have a chance to propagate in either length and depth. Each remachining of the shells reduces the thickness of the shells usually between 5% to 15%. However, the remachining process greatly extends the service life of the shells compared to what it would be without remachining. Normally, each shell can be remachined five (5) times before it has to be scrapped.

Shell service life can be measured in two ways: (1) the number of hours of operation of the shells before replacement; or (2) the number of pounds of aluminum processed before replacement. At best, prior art shells can allegedly process approximately 10 million pounds of aluminum, which equates to approximately 5000 hours of operation, before being scrapped.

The present invention provides a ferritic alloy steel for roller caster shells which has high resistance to heat cracking. The chemistry for the roller caster shell of the present invention has weight percentage ranges different from those of prior roller caster shell steels—in fact, the ranges for some of the elements are contrary to conventional teachings with respect to ferritic alloy steels for roller caster shells with long service lives.

SUMMARY OF THE INVENTION

The present invention is a ferritic alloy steel for making roller caster shells. According to the present invention, the weight percentage ranges of the constituent elements of the steel of the present invention are approximately 0.45% to 0.49% carbon, 0.90% to 1.00% manganese, 0.15% to 0.35% silicon, 0.00% maximum phosphorus, 0.002% maximum sulphur, 1.20% to 1.50% nickel, 1.20% to 1.45% chromium, 0.80% to 1.00% molybdenum, 0.15% to 0.20% vanadium, 0.08% maximum rare earth, and balance substantially iron. This steel grade was developed to optimize thermal fatigue resistance and thermal conductivity, while holding substantially steady temper embrittlement. The resistance to temper embrittlement is enhanced by the inclusion of rare earth.

An object of the present invention is to provide a roller caster shell steel with good properties with respect to high resistance to heat cracking.

Another subject of the present invention is to provide a roller caster shell steel with a long service life compared to prior art roller caster shells.

These and other objects will be set forth more fully in the remainder of the specification.

DETAILED DESCRIPTION OF THE INVENTION

The present invention is a ferritic alloy steel for roller caster shells used in roll casting molten aluminum into sheets. The steel of the present invention has constituent elements carbon, manganese, phosphorus, sulphur, silicon, nickel, chromium, molybdenum, vanadium, rare earth, and balance essentially iron by weight percentages that will be set forth subsequently.

The various constituent elements provide the following well known properties to the steel composition of the present invention. Carbon provides hardness and strength to the steel. Manganese increases hardenability, forms manganese sulfides, and provides deoxidation. Phosphorus and sulphur are residual elements that at high levels, assist in temper embrittlement—the metallurgical condition which enhances the tendency of the shells to form heat cracks. Additionally, manganese combines with sulphur to form manganese sulfides, thereby, reducing hot shortness caused by the presence sulphur. Silicon is the primary deoxidizer of the steel. Nickel promotes toughness and counterbalances the tendency of other elements to decrease toughness. Chromium provides strength and oxidation resistance at high temperatures. Molybdenum and vanadium provide increased high temperature strength to the steel. In addition, vanadium provides fine grain and resistance to softening during the temper treatment. Rare earth provides the shells with properties to avoid temper embrittlement.

In general, rare earths are soluble in steel, but do not form carbides or nitrites; however, rare earths tie-up non-metallics. Rare earths have no effect on grain size, but scavenge oxygen, sulphur, and tramp elements, and hold on to them.

The roller caster shells of the present invention are formed by the following method:

The steel composition of the present invention is cast into ingots, heated to 2300 degrees F. and upset, and then it is hot trepanned and saddle forged. This takes a total of two heats. The workpiece is then heated to 2250 degrees F. and mandrel forged to the desired dimensions. This takes an additional two heats. During the forging steps, the workpiece is open die forged and worked until it stops moving.

After the workpiece is mandrel forged, it is post-forge treated with either one of the following treatments: (1) normalized at 1850 degrees F. for 4 hours and tempered at 1200 degrees F. for 6 hours; or (2) full furnace annealled at 1650 degrees F. for 5 hours. The specific hours and temperature indicated above are selected based on product size. The selection of the post-forge treatment is based on the desired machineability of the workpiece after treatment.

Next, the workpiece is rough machined. The final heat treatment consists of a polymer quench from austenizing at 1475° F. for 4 hours and then double tempering.

In the first tempering step, the workpiece is held at 1080° F. for 4 hours and in the second, the workpiece is held at 1030° F. 4 hours. Subsequent to tempering, the workpiece is machined to finished dimensions. The desired final hardness of the workpiece after heat treatment is 415/444 BHN. The specific tempering temperatures selected are those which result in the desired final hardness in the workpiece.

The weight percentage ranges of different elements of this ferritic alloy steel specification of the present invention are shown in Table 1:

TABLE 1

| Element | % By Weight |
|---|---|
| Carbon | 0.45 to 0.49 |
| Manganese | 0.90 to 1.00 |
| Phosphorus | 0.010 maximum |
| Sulphur | 0.002 maximum |
| Silicon | 0.15 to 0.35 |
| Nickel | 1.20 to 1.50 |
| Chromium | 1.20 to 1.45 |
| Molybdenum | 0.80 to 1.00 |
| Vanadium | 0.15 to 0.20 |
| Rare Earth | 0.08 maximum |
| Balance Iron | Remainder |

The roller caster shell chemistry specification in Table 1 includes the element "Rare Earth" which assists in avoiding temper embrittlement. The addition of rare earth to the composition has helped the shells have greater resistance to initial heat cracking and, once cracking has occurred, slow the propagation of such cracking.

EXPERIMENT

Two roller caster shell having the chemistry of the present invention were produced according to the above described forging and heat treatment method. The two shells that were produced have the chemistries shown in Table 2:

TABLE 2

| Element | Heat Chemistry % By Weight | Product Chemistry % By Weight |
|---|---|---|
| Carbon | 0.47 | 0.48 |
| Manganese | 0.94 | 0.91 |
| Phosphorus | 0.009 | 0.009 |
| Sulphur | 0.002 | 0.001 |
| Silicon | 0.24 | 0.24 |
| Nickel | 1.25 | 1.29 |
| Chromium | 1.31 | 1.26 |
| Molybdenum | 0.82 | 0.88 |
| Vanadium | 0.16 | 0.17 |
| Rare Earth | 0.032 | 0.032 |
| Balance Iron | Remainder | Remainder |

The final hardness of the heat treatment was 429/444 BHN.

Roller caster shells with the chemistries shown in Table 2 were produced and used in-service. Those shells had the production dimensions for service as shown in Table 3:

TABLE 3

| Shell | I.D. | O.D. | Crown | Size | Wall Thick. | Shrink Fit |
|---|---|---|---|---|---|---|
| A | 21.899" | 23.939"–23947"–23.939" | 0.008" | 21.914" | 1.020" | 0.015" |
| B | 21.899" | 23.940"–23.948"–23.940" | 0.008" | 21.915" | 1.0125" | 0.016" |

The terms and expressions which are employed herein are used as terms of expression and not of limitation. And, there is no intention, in the use of such terms and expressions, of excluding the equivalents of the features shown, and described, or portions thereof, it being recognized that various modifications are possible in the scope of the invention.

I claim:

1. A ferritic alloy steel, in weight percent, consisting essentially of from about 0.45% to about 0.49% carbon, about 0.90% to about 1.00% manganese, about 0.010% maximum phosphorus, about 0.002% maximum sulphur, about 0.15% to about 0.35% silicon, about 1.20% to about 1.50% nickel, about 1.20% to about 1.45% chromium, about 0.80% to about 1.00% molybdenum, about 0.15% to about 0.20% vanadium, an effective amount of rare earth up to about 0.08% to avoid temper embrittlement, and balance essentially iron.

2. The steel as recited in claim 1, consists essentially of about 0.47% carbon, about 0.94% manganese, about 0.009% phosphorus, about 0.002% sulphur, about 0.24% silicon, about 1.25% nickel, about 1.31% chromium, about 0.82% molybdenum, about 0.16% vanadium, 0.032% rare earth, and balance essentially iron.

3. The steel as recited in claim 1, wherein the steel has a high resistance to heat checking or cracking when subjected to extreme heat stresses in repeated thermal cycles.

4. A roller caster shell for continuously casting aluminum into sheets formed from a ferritic alloy consisting essentially of from about 0.45% to about 0.49% carbon, about 0.90% to about 1.00% manganese, about 0.010% maximum phosphorus, about 0.002% maximum sulphur, about 0.15% to about 0.35% silicon, about 1.20% to about 1.50% nickel, about 1.20% to about 1.45% chromium, about 0.80% to about 1.00% molybdenum, about 0.15% to about 0.20% vanadium, an effective amount of rare earth up to about 0.08% to avoid temper embrittlement, and balance essentially iron.

5. The roller caster shell of claim 4, consists essentially of about 0.47% carbon, about 0.94% manganese, about 0.009% phosphorus, about 0.002% sulphur, about 0.24% silicon, about 1.25% nickel, about 1.31% chromium, about 0.82% molybdenum, about 0.16% vanadium, 0.032% rare earth, and balance essentially iron.

6. The roller caster shell of claim 4, wherein the shell has high resistance to heat checking or cracking when subjected to repeated thermal cycles in continuously casting aluminum into sheets.

* * * * *

UNITED STATES PATENT AND TRADEMARK OFFICE

CERTIFICATE OF CORRECTION

PATENT NO. : 4,861,549

DATED : August 29, 1989

INVENTOR(S) : Ashok K. Khare

It is certified that error appears in the above-identified patent and that said Letters Patent is hereby corrected as shown below:

Abstract, line 9, "0.14%" should be -- 0.15% --

Col. 2, line 9, After "elements" insert -- in composition --

Col. 2, ln. 9, "0.00%" should be -- 0.010% --

Col. 4, ln. 27, "23947"-" should be -- 23.947"- --

Signed and Sealed this

Second Day of April, 1991

*Attest:*

HARRY F. MANBECK, JR.

*Attesting Officer*

*Commissioner of Patents and Trademarks*